US007708612B2

(12) United States Patent
Wardle

(10) Patent No.: US 7,708,612 B2
(45) Date of Patent: May 4, 2010

(54) LEASH AND INFORMATION SYSTEM ASSEMBLY FOR A WATER SPORT VEHICLE

(75) Inventor: Patrick N. Wardle, 8875 Baltimore St., Savage, MD (US) 20763

(73) Assignee: Patrick N. Wardle, Columbia, MD (US)

( * ) Notice: Subject to any disclaimer, the term of this patent is extended or adjusted under 35 U.S.C. 154(b) by 0 days.

(21) Appl. No.: 12/103,128

(22) Filed: Apr. 15, 2008

(65) Prior Publication Data

US 2009/0258552 A1 Oct. 15, 2009

(51) Int. Cl.
*B63B 1/00* (2006.01)

(52) U.S. Cl. ..... 441/75; 119/770; 405/186

(58) Field of Classification Search ..... 441/75; 119/770, 795, 798; 405/186
See application file for complete search history.

(56) References Cited

U.S. PATENT DOCUMENTS

| | | | | |
|---|---|---|---|---|
| 4,610,634 | A * | 9/1986 | Kimura | 441/75 |
| 5,324,220 | A * | 6/1994 | Stewart | 441/75 |
| 5,738,556 | A * | 4/1998 | Palmieri | 441/75 |
| 6,000,979 | A * | 12/1999 | Stewart | 441/75 |
| 6,471,560 | B2 * | 10/2002 | Kerckhoff | 441/75 |
| 7,144,198 | B2 * | 12/2006 | Hirose et al. | 405/186 |

* cited by examiner

*Primary Examiner*—Lars A Olson
(74) *Attorney, Agent, or Firm*—Cermak Kenealy Vaidya & Nakajima LLP; Adam J. Cermak

(57) ABSTRACT

A leash and information system assembly includes a flexible strap, a flexible tether cord, a data processing module, and a display module. The flexible strap and the flexible tether cord connect a water sports vehicle to a user of the water sports vehicle. The flexible tether cord is connected to the flexible strap and the second end is configured and dimensioned to connect to the water sports vehicle. The tether cord width is substantially less than the strap width and the tether cord length is substantially greater than the strap length. The data processing module is mounted within a water-proof enclosure and positioned along one of the flexible strap, the flexible tether cord, and the water sports vehicle. The data processing module is configured with logic to receive, parse, process, and output data generated by a source external to the data processor. The display module is mounted within a water-proof enclosure and positioned along the flexible strap and in electrical communication with the data processing module. The display module includes a plurality of display symbols representing at least one of time, atmospheric weather conditions, water conditions, and global positioning. The display module is configured with logic to receive, process data communicated from the data processing module to convey the data to the user by activating at least one of the display symbols.

14 Claims, 1 Drawing Sheet

LEASH AND INFORMATION SYSTEM ASSEMBLY FOR A WATER SPORT VEHICLE

BACKGROUND OF THE INVENTION

1. Field of the Invention

The present invention relates to a leash and information system assembly for a water sport vehicle (for example, a surfboard, boogie board, sail board, or personal watercraft) to tether the water sport vehicle to the user and to provide the user with real-time, historical and/or forecast information during use of the water sport vehicle.

2. Brief Description of the Related Art

Leashes are used to tether surfboards, boogie boards, and sail boards to a user's wrist or ankle when in use on the water. The tether can keep the board within reach of the user when the user falls off the board while on the water.

Leashes are also used to activate a safety switch for personal watercraft. One end of the tether is attached to the user's wrist and the other end of the tether is connected to safety switch. When a user falls off the personal watercraft with the leash properly attached to the user's wrist and to the personal watercraft, the safety switch can be activated to maintain the personal watercraft within a reasonable swimming distance of the user.

Often a water sport vehicle user will need access to information such as time, atmospheric weather conditions, water conditions, and global positioning. The user must carry a separate device(s) in order to have access to this information. However, a separate device(s) can be cumbersome or otherwise intrusive on the user's water sport experience.

Therefore, there remains a need for a leash for a water sport vehicle that can also provide the user with real-time, historical, and/or forecast information without undue intrusion on the user's experience with the water sport vehicle.

SUMMARY

One of numerous aspects of the present invention includes a leash and an information assembly. The leash connects a water sports vehicle to a user of the water sports vehicle and includes a flexible strap, a flexible tether cord. The flexible strap has a width and a length and is configured and dimensioned to releasably connect to the user. The flexible tether cord has a first end, a second end, a width, and a length. The first end is connected to the flexible strap and the second end is configured and dimensioned to connect to the water sports vehicle. The tether cord width is substantially less than the strap width and the tether cord length is substantially greater than the strap length. The information system includes a data processing module, and a display module. The data processing module is mounted within a water-proof enclosure and positioned along one of the flexible strap, the flexible tether cord, and the water sports vehicle. The data processing module is configured with logic to receive, parse, process, and output data generated by a source external to the data processor. The display module is mounted within a water-proof enclosure and positioned along the flexible strap and in electrical communication with the data processing module. The display module includes a plurality of display symbols representing at least one of time, atmospheric weather conditions, water conditions, and global positioning. The display module is configured with logic to receive, process data communicated from the data processing module to convey the data to the user by activating at least one of the display symbols.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
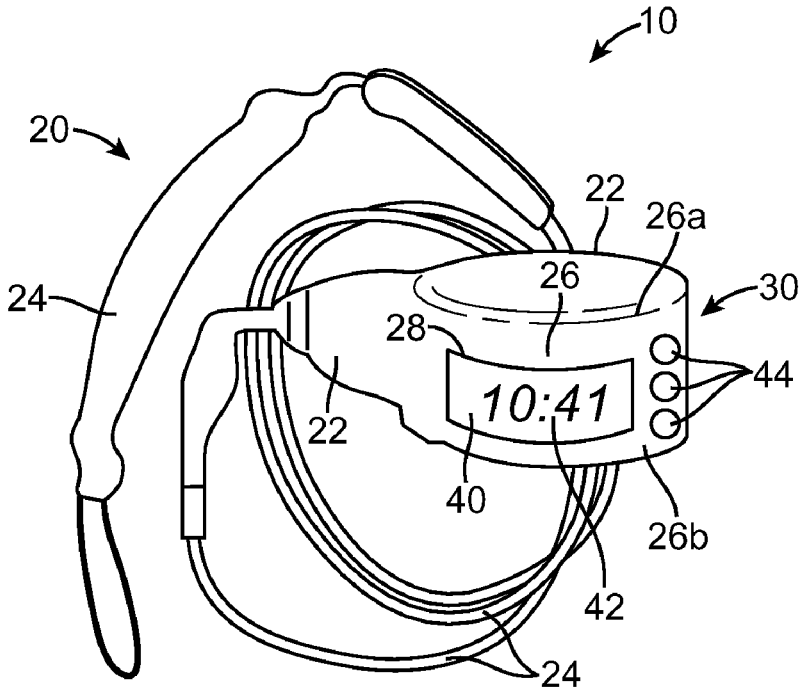
FIG. 1 illustrates a leash and information system for a water sport vehicle in accordance with the present invention.

Referring to the drawing figures, like reference numerals designate identical or corresponding elements throughout the several figures.

With reference to FIG. 1, an assembly 10 according to an embodiment of the disclosed invention can include a leash 20 and an information system 30. The leash 20 can include a flexible strap 22 and a flexible tether cord 24 connected to the flexible strap 22. The flexible strap 22 can be configured and dimensioned to releasably connect to the user of the water sport vehicle in any manner known in the art. The flexible tether cord 24 can be configured and dimensioned to connect to the water sport vehicle in any manner known in the art. As depicted in FIG. 1, each of the flexible strap 22 and the flexible tether cord 24 can have a length and a width. Preferably, the width of the flexible tether cord 24 can be substantially less than the width of the flexible strap 22 and the length of the flexible tether cord 24 can be substantially greater than the length of the flexible strap 22.

Figure 2:
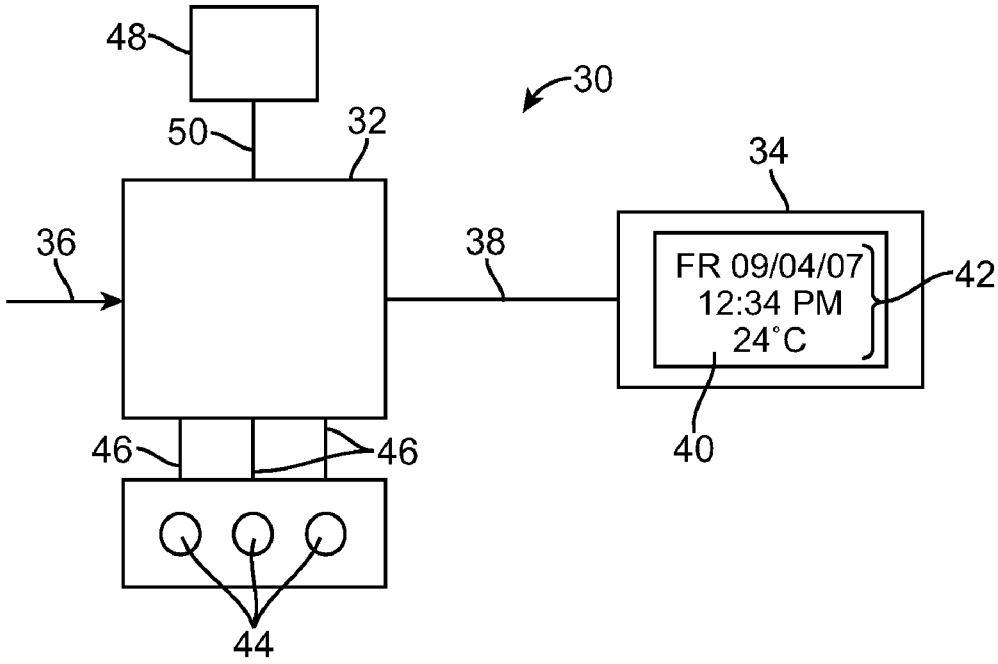
FIG. 2 schematically illustrates an information system in accordance with the present invention.

As schematically represented in FIG. 2, the information system 30 can include a data processing module 32 and a display module 34. The data processing module 32 can be configured with logic in any manner known in the art to obtain data from an external source (for example, a radio broadcast, Bluetooth transmission, SMS text messaging, portable memory device, and hardwired input port), process the data, and output the data to the user in a readily legible manner. The data can represent time, atmospheric weather conditions, water conditions, and/or global positioning. The time data can include year, month, day, hour, minute, second, elapsed time, alarm settings, etc. The atmospheric weather condition data can include air temperature, wind speed, wind direction, cloud condition, humidity, pressure, daily forecast, etc. The water condition data can include water temperature, speed of the water current, direction of the water current, tide type, tide time, wave height, etc. The global positioning data can include geographic location, surfing location(s), beach location(s), traffic conditions, map directions, street maps, etc. The data can represent real-time data, historical data, and/or forecast data. Additionally, the data processing module 32 can be configured with logic to store the received data and process the data into an historical representation.

With reference to FIG. 2, the data processing module 32 can include an input 36 to receive data from any external source in any manner known in the art. For example, the input can be an antenna to receive data broadcast over a Radio Data System standard and can be configured logic with logic to process the broadcast data. The antenna can be internally integrated with the data processing module such as in a wireless laptop computer. Alternatively, the input 36 can be an input port to receive data from a portable memory device, computer, etc.

The display module 34 can be in electrical communication with the data processing module. The electrical communication (indicated by line 38) between the data processing module 32 and the display module 34 can be provided by a wireless connection or by a wired connection.

As illustrated in FIG. 2, the display module 34 can include a display screen 40. The display screen 40 can be a multifunctional digital display screen, such as a conventional digital wrist watch display, an LCD, or LED display. The display screen 40 can include a plurality of display symbols 42 that can represent the time, atmospheric weather conditions, water conditions, and/or global positioning data. The display symbols 42 can form a number(s), letter(s), word(s), and/or icon(s) that represent the data in a manner readily understandable by the user. The display module 34 can be configured with logic in any manner known in the art to receive and process the data communicated from the data processing module 32 and to convey the data to the user by activating/deactivating an appropriate one(s) of the display symbols 42.

The data processing module 32 and the display module 34 can be positioned at any location on the leash 20 separately as individual components or together as an integrated component. The position of the data processing module 32, including integration of the data processing module 32 with the display module 34, can be determined based on weight, size, complexity, functionality, and/or accessibility by the user while minimizing intrusion on user's the enjoyment of water sport vehicle. Preferably, the display module 34 can be positioned on the flexible strap 22.

Preferably, the information system 30 can be integrated with the leash 20 in such a manner that the presence of the information system 30 is unnoticeable to the user until the user consciously chooses to acknowledge the presence of the information system 30. For example, the sum of the weights of the data processing module 32 and the display module 34 can be approximately less than sum of the weights of the flexible strap 22 and the flexible tether cord. Thus, the user can obtain useful and/or essential information relevant to the water sport activity without intrusive effect from a device(s) additional to the leash 20, such as a wrist watch, hand-held radio, or hand-held global positioning system.

In the embodiment illustrated in FIG. 1, the data processing module 32 (not visible) and the display module 34 (only the display screen 40 is visible) can be integrated into a single component and positioned on the flexible strap 22. Preferably, the data processing module 32 and the display module 34 can be in electrical communication via a wired electrical connection or a circuit board assembly.

In an embodiment of the information system 30 where the data processing module 32 and the display module 34 are separate and distinct components, the display module 34 can be positioned at a location on the flexible strap 22 and the data processing module 34 can be positioned at one of three different localities. That is, the data processing module 34 can be positioned at a location on the flexible strap 22 separate and spaced from the display module 34 location, at a location on the flexible tether cord 24, or at a location on the water sport vehicle. If the data processing module 32 is positioned on the flexible tether cord 24 or on the water sport vehicle, an electrical wire(s) can be encapsulated within the flexible tether cord 24 and/or the flexible strap 22 to electrically connect the display module 34 to the data processing module 32.

Preferably, the modules 32, 34 can be mounted within a water-proof enclosure. Each module 32, 34 can be mounted in a respective water-proof enclosure or a single water-proof enclosure can contain both modules 32, 34. The water-proof enclosure can be secured to the leash 20.

As shown in FIG. 1, the leash 20 can include a water-proof enclosure in the form of a water-proof housing 26. The data processing module 32 (not visible) and the display module 34 (only the display screen 40 is visible) can be mounted within the water-proof housing 26.

The housing 26 can be configured and dimensioned to be complimentary to the shape of a user's wrist or ankle. For example, as illustrated in FIG. 1, the housing 26 can include a curved inner surface 26*a* and a curved outer surface 26*b*. Alternatively, the housing 26 can include flat inner and outer surfaces.

The water-proof housing 26 can include a window opening 28. As depicted in FIG. 1, the window opening 28 can be curved in a complimentary manner to the curvature of the housing outer surface 26*b*. The display module 32 can be mounted within the housing 26 with the display screen 40 in alignment with the window opening 28.

The information system 30 can also include at least one button 44 in electrical communication with either one or both of the data processing module 32 and the display module 34. In FIGS. 1 and 2, three buttons 44 are illustrated. However, any number of buttons 44 can be employed to provide the user with efficient access to the data contained within the information system 30.

The button(s) 44 can be positioned at any convenient location on the leash 20. Preferably, the button(s) 44 can be positioned on the flexible strap 22 in proximity to the display window 26. Alternatively, the button(s) 44 can be located on the inside of the flexible strap 22.

As shown in FIG. 2, the buttons 44 can be in electrical communication (indicated by lines 46 with the data processing module 32. The data processing module 32 can be configured with logic in any manner known in the art to receive an electrical signal (via lines 46) from the buttons 44 and process the button inputs. The display module 34 can be configured with logic in any manner known in the art to activate an appropriate symbol(s) 42 on the display screen 40 based on the button input signal processed by the data processing module 32 and output to the display module 34.

As discussed above, information system 30 should not be noticeably intrusive on the user's experience with the water sport vehicle. As such, it is preferred that the combined weights of the button(s) 44, the housing 26, and the modules 32, 34 should be no greater than the combined weight of flexible strap 22 and the flexible tether cord 24.

With reference to FIG. 2, the information system 30 can also include a temperature sensor 48 in electrical communication (indicated by line 50) with the data processing module 32. The electrical communication (indicated by line 50) between the temperature sensor 48 and the data processing module 32 can be provided by a wireless connection or by a wired connection. The temperature sensor 48 can be mounted to any one of the flexible strap, the flexible tether cord, and the water sports vehicle. The temperature sensor 48 can be configured to measure water temperature and/or air temperature.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents.

What I claim is:

1. A leash and information system assembly to connect a water sports vehicle to a user of the water sports vehicle, the assembly comprises:

a flexible strap having a width and a length, the flexible strap is configured and dimensioned to releasably connect to the user; and a flexible tether cord having a first end, a second end, a width, and a length; the first end is connected to the flexible strap; the second end is configured and dimensioned to connect to the water sports vehicle; the tether cord width is substantially less than the strap width; and the tether cord length is substantially greater than the strap length;

a data processing module mounted within a water-proof enclosure and positioned along one of the flexible strap, the flexible tether cord, and the water sports vehicle, and the data processing module is configured with logic to receive, parse, process, and output data generated by a source external to the data processor; and a display module mounted within a water-proof enclosure and positioned along the flexible strap and in electrical communication with the data processing module, and the display module includes a plurality of display symbols representing at least one of time, atmospheric weather conditions, water conditions, and global positioning, and the display module is configured with logic to receive, process, and display data communicated from the data processing module to convey the data to the user by activating at least one of the display symbols;

wherein the flexible strap comprises a window opening and at least a portion of the display module is aligned with the window opening.

2. The assembly according to claim 1, wherein each of the flexible strap, the flexible tether cord, the data processing module, and the display module have a respective weight and the sum of the respective weights of the data processing module, and the display module is less than the sum of the respective weights of the flexible strap and the flexible tether cord.

3. The assembly according to claim 1 further comprises a temperature sensor mounted to one of the flexible strap, the flexible tether cord, and the water sports vehicle and the temperature sensor is in electrical communication with the data processing module.

4. The assembly according to claim 3, wherein the temperature sensor is in wireless electrical communication with the one of the data processing module and the display module.

5. The assembly according to claim 1 further comprises at least one button in electrical communication with one of the data processing module and the display module; and the one of the data processing module and the display module is further configured with logic to receive and process an electrical signal from the at least one button and output a corresponding display signal; and the display module is further configured with logic to activate at least one of the display symbols based on the corresponding display signal.

6. The assembly according to claim 1, wherein the display module comprises an arcuate display surface and the display symbols are located on the arcuate display surface.

7. The assembly according to claim 1, further comprises at least one button positioned adjacent the window opening and in electrical communication one of the data processing module and the display module.

8. The assembly according to claim 1, wherein the water-proof enclosure on the flexible strap comprises a rigid, water-proof housing.

9. The assembly according to claim 8, wherein the data processing module is mounted within the rigid, water-proof housing.

10. The assembly according to claim 9, wherein the rigid water-proof housing further comprises a plurality of buttons movably mounted on an external surface of the rigid water-proof housing and in electrical communication with at least one of the display module and the data processing module.

11. The assembly according to claim 10 further comprises a temperature sensor mounted to one of the flexible strap, the flexible tether cord, and the water sports vehicle and the temperature sensor is in electrical communication with the data processing module.

12. The assembly according to claim 11, each of the rigid water-proof housing, the data processing module, the display module, the plurality of buttons, the flexible strap, and the flexible tether cord have a respective weight and the sum of the respective weights of the rigid water-proof housing, the data processing module, the display module, and the plurality of buttons is at most equal to the sum of the respective weights of the flexible strap and the flexible tether cord.

13. A leash and information system assembly to connect a water sports vehicle to a user of the water sports vehicle, the assembly comprises:

a flexible strap having a width and a length, the flexible strap is configured and dimensioned to releasably connect to the user; and a flexible tether cord having a first end, a second end, a width, and a length; the first end is connected to the flexible strap; the second end is configured and dimensioned to connect to the water sports vehicle; the tether cord width is substantially less than the strap width; and the tether cord length is substantially greater than the strap length;

a data processing module mounted within a water-proof enclosure and positioned along one of the flexible strap, the flexible tether cord, and the water sports vehicle, and the data processing module is configured with logic to receive, parse, process, and output data generated by a source external to the data processor; and a display module mounted within a water-proof enclosure and positioned along the flexible strap and in electrical communication with the data processing module, and the display module includes a plurality of display symbols representing at least one of time, atmospheric weather conditions, water conditions, and global positioning, and the display module is configured with logic to receive, process, and display data communicated from the data processing module to convey the data to the user by activating at least one of the display symbols;

wherein the display module is in wireless electrical communication with the data processing module.

14. A leash and information system assembly to connect a water sports vehicle to a user of the water sports vehicle, the assembly comprises:

a flexible strap having a width and a length, the flexible strap is configured and dimensioned to releasably connect to the user; and a flexible tether cord having a first end, a second end, a width, and a length; the first end is connected to the flexible strap; the second end is configured and dimensioned to connect to the water sports vehicle; the tether cord width is substantially less than the strap width; and the tether cord length is substantially greater than the strap length;

a data processing module mounted within a water-proof enclosure and positioned along one of the flexible strap, the flexible tether cord, and the water sports vehicle, and the data processing module is configured with logic to receive, parse, process, and output data generated by a source external to the data processor;

a display module mounted within a water-proof enclosure and positioned along the flexible strap and in electrical communication with the data processing module, and the display module includes a plurality of display symbols representing at least one of time, atmospheric weather conditions, water conditions, and global positioning, and the display module is configured with logic to receive, process, and display data communicated from the data processing module to convey the data to the user by activating at least one of the display symbols; and an electrical wire extending within at least one of the flexible tether cord and the flexible strap and the electrical wire is connected to the data processing module and to the display module.

* * * * *